US007648261B2

(12) United States Patent
Ko et al.

(10) Patent No.: US 7,648,261 B2
(45) Date of Patent: Jan. 19, 2010

(54) ADJUSTABLE UTILITY LIGHT AND METHODS OF USE THEREOF

(76) Inventors: Wai-Shing Peter Ko, 125 Holly Springs Dr., Peachtree City, GA (US) 30269; Jon Eric Gibson, 15 Carriage Park Ct., Oxford, GA (US) 30054

( * ) Notice: Subject to any disclaimer, the term of this patent is extended or adjusted under 35 U.S.C. 154(b) by 0 days.

(21) Appl. No.: 11/924,774

(22) Filed: Oct. 26, 2007

(65) Prior Publication Data

US 2009/0109679 A1 Apr. 30, 2009

(51) Int. Cl.
*F21V 21/00* (2006.01)

(52) U.S. Cl. ..... 362/396; 362/269; 362/303; 362/368; 362/371

(58) Field of Classification Search ..... 362/396, 362/368, 372, 371, 269, 418
See application file for complete search history.

(56) References Cited

U.S. PATENT DOCUMENTS 3,154,252 A * 10/1964 Baake ..... 362/222
3,511,985 A * 5/1970 Muscovitch ..... 362/282
5,217,297 A * 6/1993 Yuen ..... 362/184
5,765,941 A * 6/1998 Vest ..... 362/260
6,123,434 A 9/2000 Meltzer
6,663,265 B2 12/2003 Kovacik et al.
7,246,927 B2 7/2007 Wikle et al.
2003/0035287 A1* 2/2003 Kovacik et al. ..... 362/223
2006/0034078 A1* 2/2006 Kovacik et al. ..... 362/227
2007/0217206 A1* 9/2007 Bayat et al. ..... 362/362

* cited by examiner

*Primary Examiner*—Sandra L O'Shea
*Assistant Examiner*—Jessica L McMillan
(74) *Attorney, Agent, or Firm*—Williamson Intellectual Property Law, LLC; Thomas R. Williamson, III

(57) ABSTRACT

An adjustable utility light having a body section, two independently movable hooks, a pivoting lamp section having fluorescent tubes and/or light emitting diodes, a component retention tray, at least one keyhole mounting slot, and a movable reflector, wherein the pivoting lamp section and the movable reflector pivot about the same pivot axis.

19 Claims, 9 Drawing Sheets

ADJUSTABLE UTILITY LIGHT AND METHODS OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to utility lights, and more specifically to an adjustable task, 'trouble', drop or work light with multiple suspension or mounting options, wherein a lamp section pivots open up to slightly greater than 90 degrees (or up to 180 degrees in an alternate embodiment) exposing the lamp section from one or both sides when in use, thereby providing the ability to aim the light in a selected direction or at a selected area. A pivoting reflector may selectively be utilized to augment and direct light where desired.

2. Description of Related Art

Task or utility lights are typically utilized to extend light into a non-illuminated or poorly illuminated location, often remote from a power source, such as, under an automobile during service, in attic areas, and in exterior locations for use at night. Such lights typically undergo severe handling and are often utilized in close quarters. Often, the direction of illumination of the utility light is limited to the positioning of the utility light itself, which can be quite awkward and inefficient in a tightly confined workspace. Those who have used utility lights will quickly recognize that because of the frequently changing location of the utility light, finding a location for hanging and correctly orienting the light is often difficult. Further, those skilled in the art will readily appreciate that different levels of illumination are required for different work locations.

While previous lights existed with incandescent sources, more commonly fluorescent lighting is used. However, both incandescent light sources and fluorescent light sources comprise glass bulbs or tubes that are subject to breakage and which thus must be protected, typically by a rigid metal screen shell (that casts shadows) or where unimpeded radiation is required, by a clear plastic lens that adds complexity and weight to the lighting device, and also reduces light by about 10%.

One previous device provides dual bulbs to increase light and has hooks at both ends for hanging the task light. However, once installed (hanging by its hooks or lying on a flat surface), the lamp lacks a facility for further adjustment. Further, hooks that protrude can be bent, broken or can snag on other objects during use and/or transport.

Another prior task light has a hook at the top and allows for pivoting forward of the bulb section by up to 90 degrees for positioning of the lamp towards the work site. While this provides some flexibility, it does not adequately provide the ability to illuminate different areas unless the device is removed from its support. Further, because the pivoting movement is part of the bulb removal operation, the bulb is exposed when pivoted, thereby rendering the bulb susceptible to damage and the user to potential injury from broken glass and/or burns.

Yet another prior utility flashlight provides a hook at the top thereof, but, while portable, requires a heavy battery base for operation. This device pivots approximately 90 degrees from its base and cannot be operated when removed from its base. This device further provides a snap-on reflector that facilitates directing of light; however, this reflector is a separate component that can become misplaced and thus unavailable. Once disposed on the lamp, the reflector must be completely removed when not needed.

Therefore, it is readily apparent that there is a need for an adjustable utility light and methods of use thereof, wherein the adjustable utility light comprises a pivotal lamp portion that can provide full 90 degree plus (or up to 180 degrees in an alternate embodiment) maneuverability for aiming of light beams once the utility light is in place, along with a reflector that can be selectively positioned to provide full or partial reflection, or can be pivoted away when not in use. The utility light should be capable of securing to a variety of fixed locations. Further, the device should be robust and capable of being manufactured utilizing different light sources.

BRIEF SUMMARY OF THE INVENTION

Briefly described, in a preferred embodiment, the present invention overcomes the above-mentioned disadvantages and meets the recognized need for such a device by providing an adjustable utility light and methods of use thereof, wherein the adjustable utility light comprises a handle section, a housing or tray section, a lamp section and a reflector. The lamp section and reflector pivot through slightly greater than 90 degrees (or up to 180 degrees in an alternate embodiment) to permit direction of light where desired, and the reflector is independent to provide a selected amount of reflection/direction of light.

Both the lamp section and reflector pivot into the tray section for storage when not in use or when desired as a linear hand-held illumination apparatus. The adjustable utility light further has two independently swiveling hooks at the top, wherein the hooks are utilized to secure the adjustable utility light to doors, automobile hood latches or the like. The adjustable utility light is easily hung from a variety of locations due to having more than one hook, wherein the hooks are stored to secure same from breakage. The tray section may be utilized to retain small components during work and further has a flat bottom to retain the adjustable utility light when it is placed on a flat surface.

The lamp section comprises fluorescent or light emitting diode (LED) light sources. When a fluorescent source is utilized, a protective covering lens is utilized to prevent damage and provide a robust structure; however, the lens may optionally be installed when LEDs are utilized to provide additional protection thereto.

According to its major aspects and broadly stated, the present invention in its preferred form is an adjustable utility light with a body section, a pivoting lamp section and a movable reflector, wherein the pivoting lamp section and the movable reflector pivot about the same pivot axis.

The adjustable utility light includes a component retention tray and a set of two movable hooks that both pivot and slide independently from one another. The replaceable light source is selectively either a fluorescent lamp tube or light emitting diodes. The adjustable utility light may also include a power outlet and/or at least one keyhole mounting slot.

More specifically, the present invention is an adjustable utility light having a handle section, a power cord, a lamp section, a reflector, securing hooks, a tray and a power switch. The lamp section and reflector are pivotally attached to the tray at a pivot disposed at the junction of the tray with the handle section that provides a common axis for the lamp section and the reflector.

The handle section has a grip with ridges thereon for a user's fingers, thereby providing comfortable hand retention of the adjustable utility light. The lamp section has a lens, a base and a top made of a suitable resilient material, such as rubber or plastic. The lens may be made from any transparent or translucent material suitable for protectively enclosing a light source. The base retains the lamp section and secures same to the tray via the pivot that permits the lamp section to be pivoted by slightly greater than 90 degrees (or up to 180 degrees in an alternate embodiment). A pin-and-anchor fastener provides for removal and replacement of the lamp section.

Independently movable hooks are swivelly attached to the tray to permit rotation of the hooks into a selected position for attachment to a fixed object, such as a door, an automobile hood latch, or the like. A standard power cord connects to a wall power outlet and provides electricity to the lamp section. Alternately, battery power could be utilized in lieu of the power cord/mains power.

In an alternate embodiment the adjustable utility light could have a power outlet in electrical communication with the power cord to permit additional devices to be powered. In another alternate embodiment the hooks could be slidably retained within swivels, thereby permitting extension of the hooks. In yet another alternate embodiment the utility light could have light emitting diodes as its light source. In this alternate embodiment, a lens is not required due to robust nature of light emitting diodes, but a lens may be selectively utilized to provide filtering of light to provide passage of the desired wavelengths of light.

The adjustable utility light is connected to a power source, and transported to and/or placed in a selected location. Previously or subsequently, the lamp section is pivoted into position to aim the adjustable utility light and to provide optimum desired light to a work object. The optional reflector is selectively pivotally positioned away from or against the lamp section to provide 360 degree lighting or 180 degree lighting, respectively. The reflector may be positioned a distance away from the lamp section to moderate light in that direction, while permitting full illumination in other directions. The adjustable utility light may be switched on either prior to, or subsequently to, placement in position and/or pivoting of the lamp section and/or the reflector.

The lamp top provides a cool insulating grip to maneuver or position the lamp section. The lamp section is replaceable by removal of a pin-and-anchor fastener on the base that permits subsequent removal of the lamp section.

The adjustable utility light is hung on a selected object by utilizing at least one of the two hooks by swiveling and/or slidably extending the hooks into position. Alternately, the adjustable utility light may be secured to a flat vertical surface, or underneath a horizontal surface by passing a screw or other fastener through the keyhole and securing the screw into the surface. Further, the adjustable utility light can be placed unsecured upon a flat surface where the flat surface of the tray prevents rolling. Small components may be placed in the tray for retention.

When desired, adjustable utility light is gripped in a user's hand engaging user's fingers via ridges of the grip portion. Thus, adjustable utility light is readily transportable and aimable by a user as desired.

Accordingly, a feature and advantage of the present invention is its ability to provide augmented light through use of a pivoting reflector.

Another feature and advantage of the present invention is its ability to pivot its lamp portion from 0 to slightly greater than 90 degrees (or up to 180 degrees in an alternate embodiment).

Still another feature and advantage of the present invention is its ability to be supported by retractable hooks.

Yet still another feature and advantage of the present invention is its ability to be secured to a variety of profiles, such as, rods, doors, flat surfaces, automobile hoods and latches for same, edge of a block and the like, or suspended from a line or cable.

Yet a further feature and advantage of the present invention is that it provides a work tray for secure support and retention of small components.

Yet still a further feature and advantage of the present invention is that it provides light 360 degrees around its lamp portion.

Yet another feature and advantage of the present invention is its use of fluorescent light sources, or, alternatively, robust light emitting diode light sources.

A further feature and advantage of the present invention is its variety of mounting options, such as via hooks or keyhole slots.

Still and additional feature and advantage of the present invention is its ability to be placed on the ground or other similar flat surface and be retained thereon with great stability.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS OF THE INVENTION

In describing the preferred and selected alternate embodiments of the present invention, as illustrated in FIGS. 1-7B, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
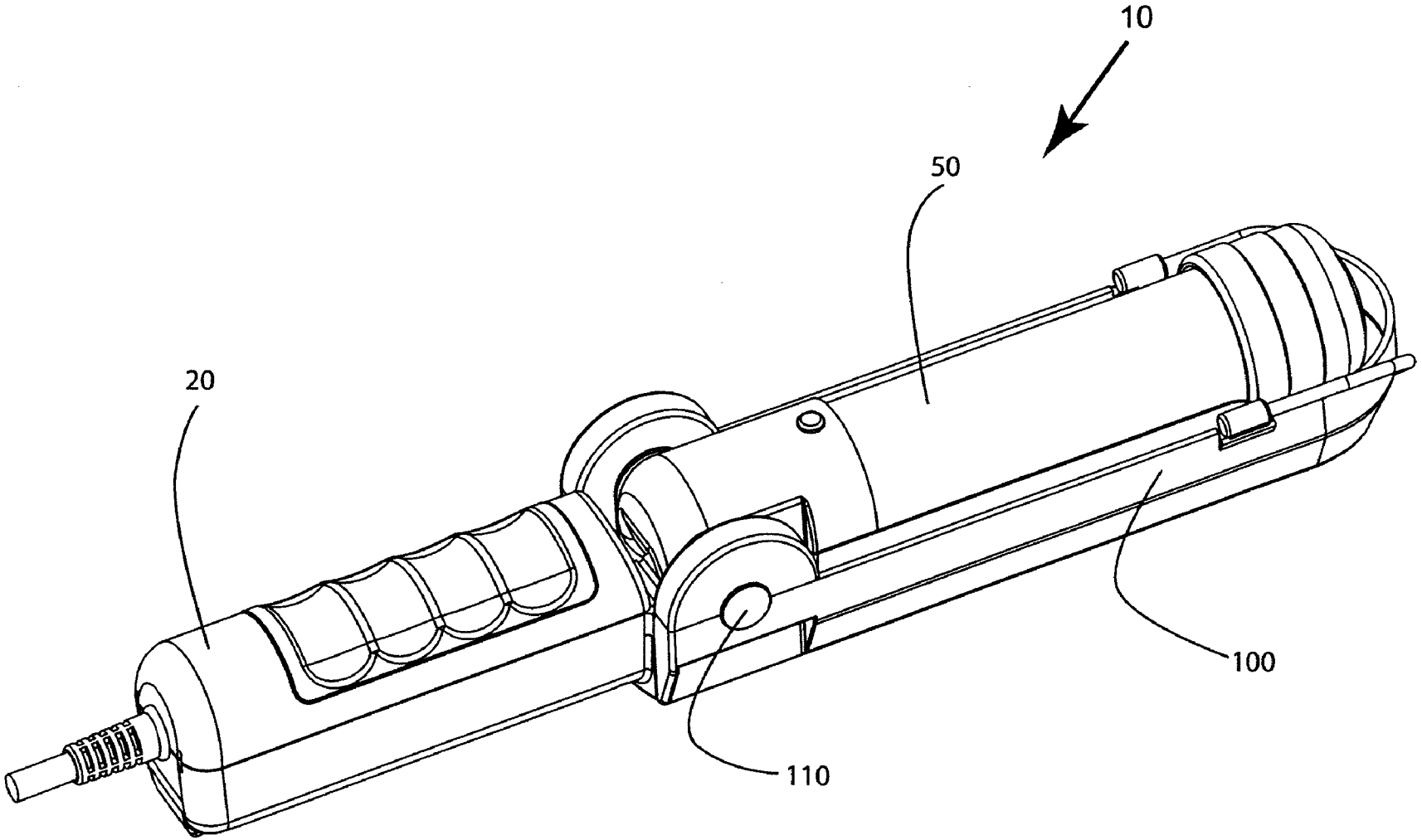
FIG. 1 is a perspective view of an adjustable utility light according to a preferred embodiment of the present invention, with lamp in closed position.
Figure 2:
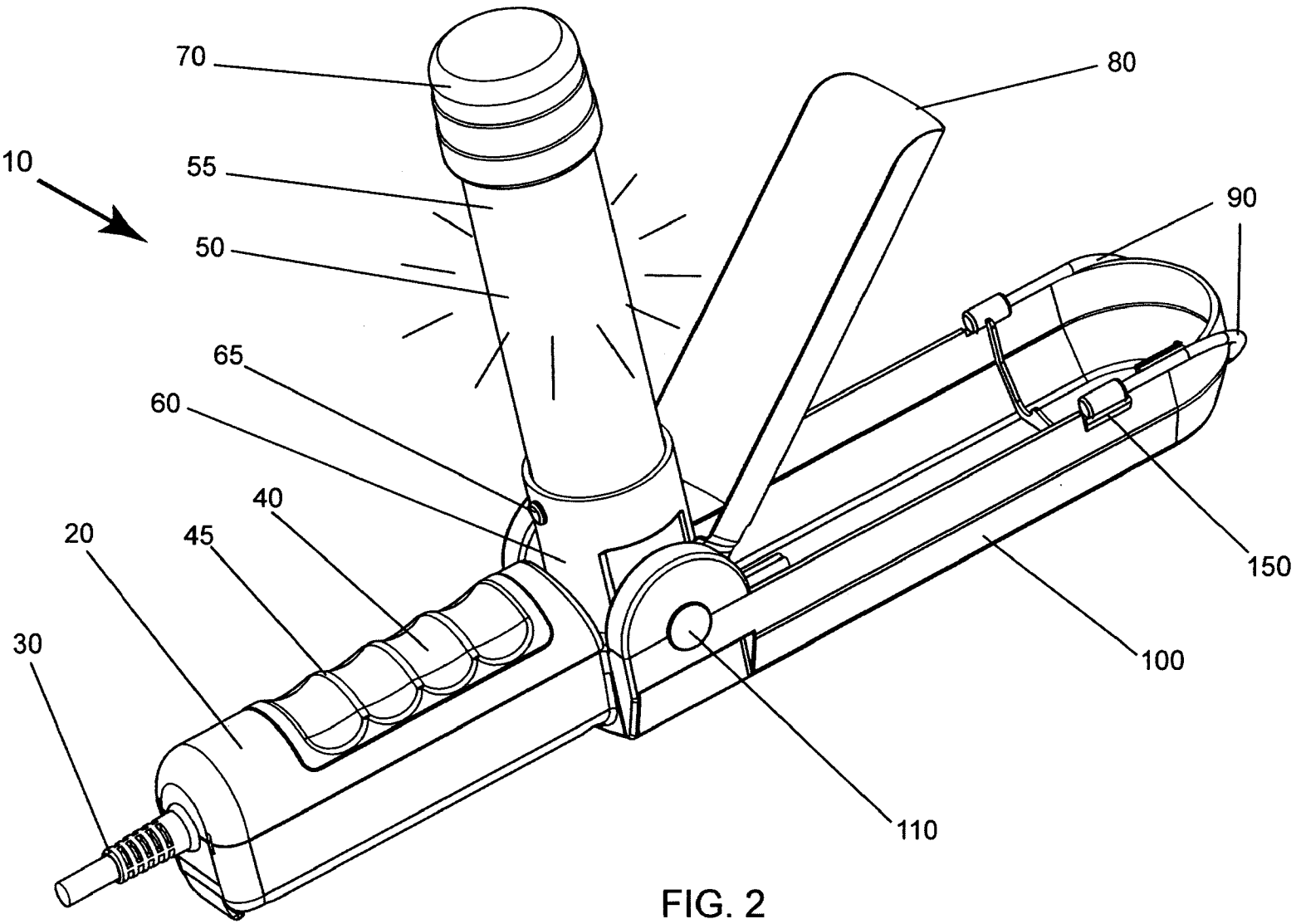
FIG. 2 is a perspective view of an adjustable utility light according to a preferred embodiment of the present invention, with lamp portion pivoted approximately 90 degrees and reflector pivoted approximately 45 degrees.
Figure 3:
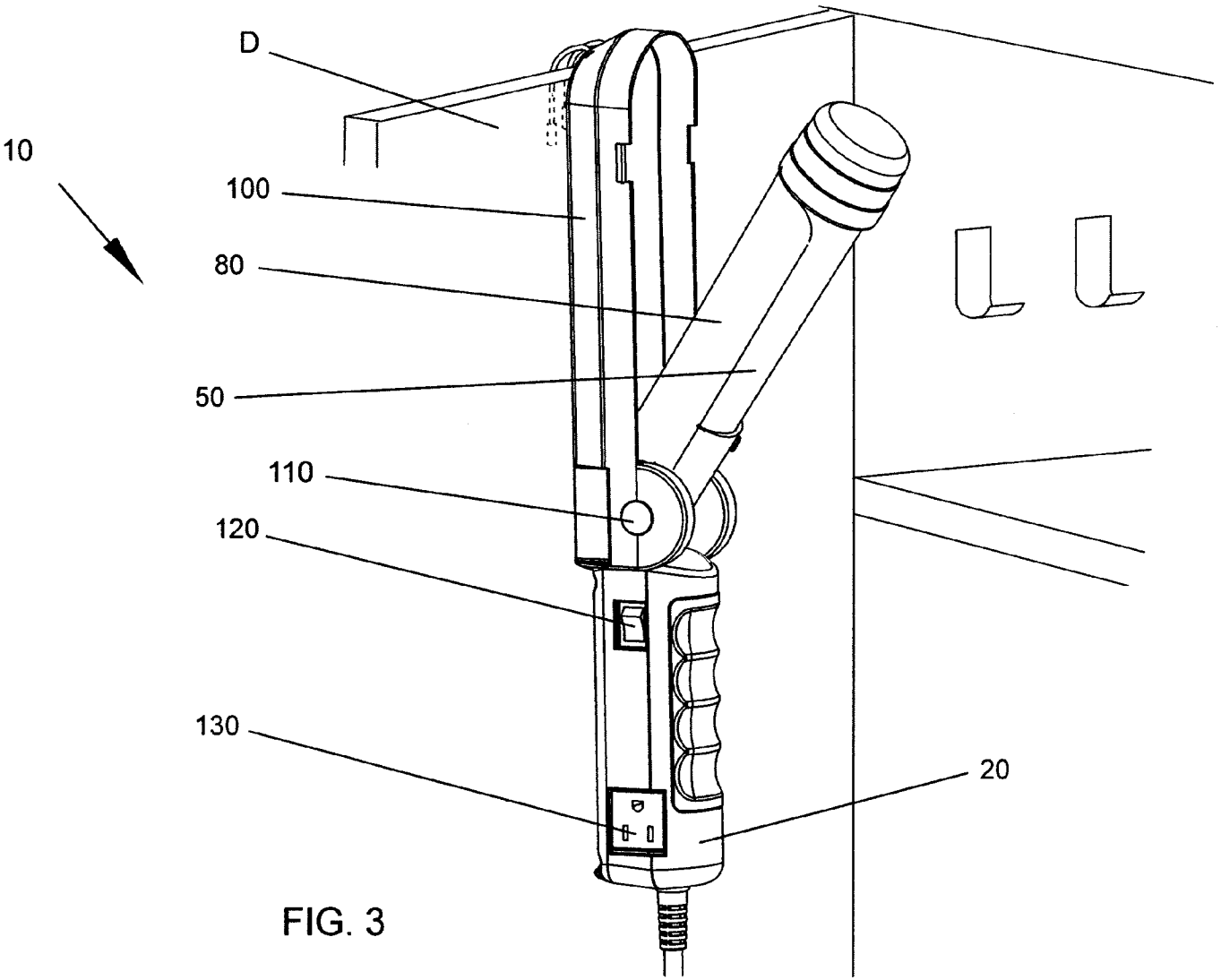
FIG. 3 is a side perspective view of an adjustable utility light according to a preferred embodiment of the present invention secured over a door, with reflector disposed proximate lamp portion.
Figure 4:
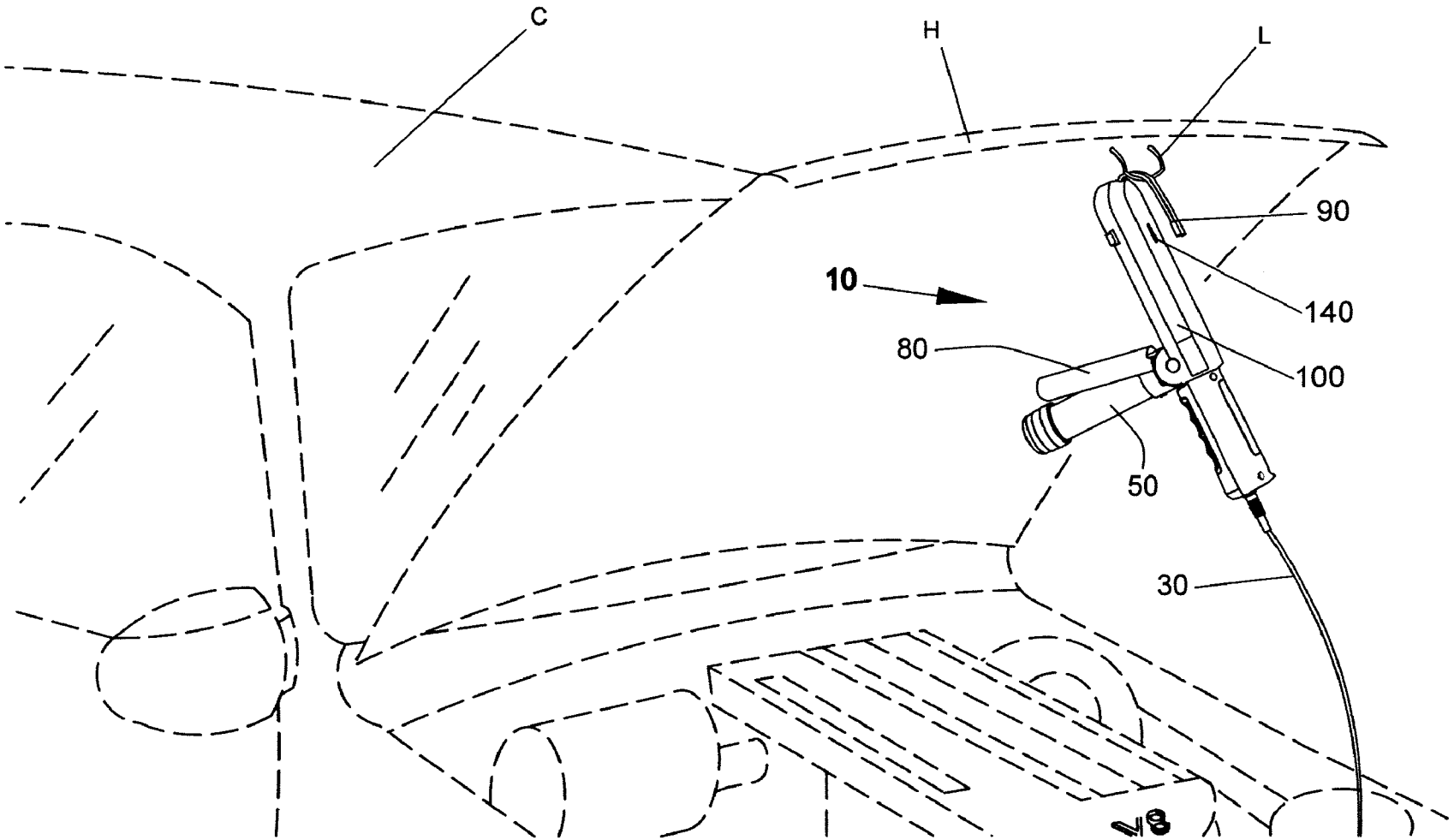
FIG. 4 is a perspective view of an adjustable utility light according to a preferred embodiment of the present invention secured to an automobile hood latch, with lamp portion pivoted approximately 90 degrees and reflector positioned slightly away from lamp portion.

Referring now to FIGS. 1-5A and 6, the present invention in a preferred embodiment is adjustable utility light 10, wherein adjustable utility light 10 preferably comprises handle section 20, power cord 30, lamp section 50, reflector 80, hooks 90, tray 100 and switch 120 (best shown in FIG. 3). Lamp section 50 and reflector 80 are preferably pivotally attached to tray 100, wherein pivot 110 provides a common axis for lamp section 50 and reflector 80 at junction of tray 100 with handle section 20.

Grip 40 is preferably disposed on handle section 20, wherein grip 40 has ridges 45 for accommodation of a user's fingers to provide comfortable hand retention of adjustable utility light 10. Lamp section 50 preferably comprises lens 55, base 60 and top 70, wherein top 70 preferably comprises a suitable resilient material, as such is known in the art, for protection of surfaces against which lamp section 50 could contact. Lens 55 preferably comprises any transparent or translucent material suitable for protectively enclosing a light source, as such is known in the art. Base 60 preferably secures lamp section 50 to tray 100 via pivot 110, wherein pivot 110 permits lamp section 50 to be pivoted by slightly greater than 90 degrees. Pin-and-anchor fastener 65 preferably provides release of lens 55 for removal and replacement of fluorescent tube 310 therewithin (best shown in FIG. 5A).

Hooks 90 are preferably secured via swivels 155 (best shown in FIG. 6), wherein swivels 155 permit rotation of hooks 90 into a selected position for attachment to a fixed object. Hooks 90 rotate into storage rests 150 when not in use.

Power cord 30 is such as is commonly known in the art for connection to mains power or to another extension cord and power cord 30 is preferably in electrical communication with lamp section 50. It will be recognized by those skilled in the art that any power source could be utilized in lieu of power cord 30 without departing from the spirit of the present invention, such as, for exemplary purposes only, battery power.

In use, adjustable utility or task light 10 is preferably plugged into a mains power outlet, and transported to and placed in a selected location. Utility or task light lamp section 50 is pivoted into position to aim adjustable utility light 10 and to provide optimum desired light to a work object. Reflector 80 is preferably selectively pivoted away from, or against, lamp section 50 to provide 360 degree lighting or 180 degree lighting, respectively, or any amount in between by variable placement of reflector 80. Adjustable utility light 10 may be switched on either prior to, or subsequently to, placement in position and/or pivoting of lamp section 50 and/or reflector 80. Gripping lamp section 50 by lamp top 70 preferably provides a cool insulating grip, wherein lamp section 50 can be maneuvered and positioned. Lens 55 is replaced by removing release pin-and-anchor fastener 65, wherein lens 55 is subsequently removed from base 60.

Adjustable utility light 10 is hung on a selected object, such as, for exemplary purposes only, latch L of hood H of car C, or, alternately, on door D, utilizing at least one of said set of hooks 90 by swiveling and/or slidably extending same into position, or, alternately, adjustable utility light 10 may be secured to a flat surface, such as a vertical surface or underneath a horizontal surface via engaging of keyhole 140 by passing a fastener therethrough and securing the fastener to the surface. Further, adjustable utility light 10 can be placed unsecured upon a flat surface, wherein flat nature of tray 100 prevents rolling thereon. Small components may be placed in tray 100 for retention therein, when adjustable utility light 10 is disposed on top of a flat surface.

When desired as a mobile 'flashlight', adjustable utility light 10 is gripped in user's hand via grip 40, engaging user's fingers on ridges 45. Thus, adjustable utility light 10 is readily transportable and aimable by a user as desired.

In an alternate embodiment of the present invention, utility light 10 could further comprise power outlet 130, wherein power outlet 130 is in electrical communication with power cord 30, and wherein additional devices may be selectively plugged into power outlet 130 to derive their power therefrom.

Figure 6:
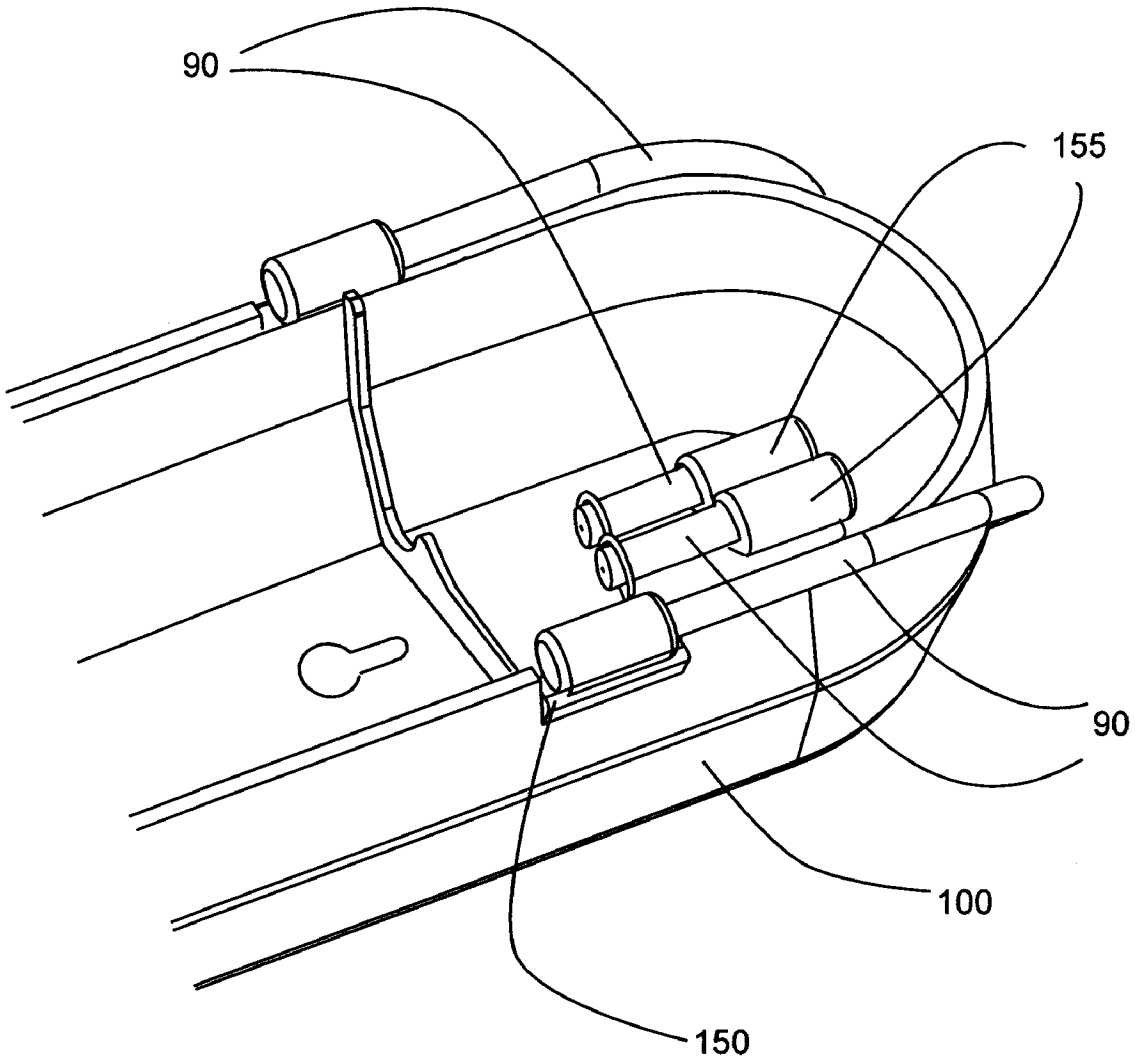
FIG. 6 is a perspective view of the interior of the tray of an adjustable utility light according to a preferred embodiment of the present invention.

In another alternate embodiment of the present inventions, hooks 90 could be slidably retained within swivels 155, thereby permitting extension of hooks 90 (best shown in FIG. 6).

In yet another alternate embodiment of the present invention, tray 100 could be shorter, or even non-existent. In the latter case, hooks 90 would be disposed proximate pivot 110.

Figure 5A:
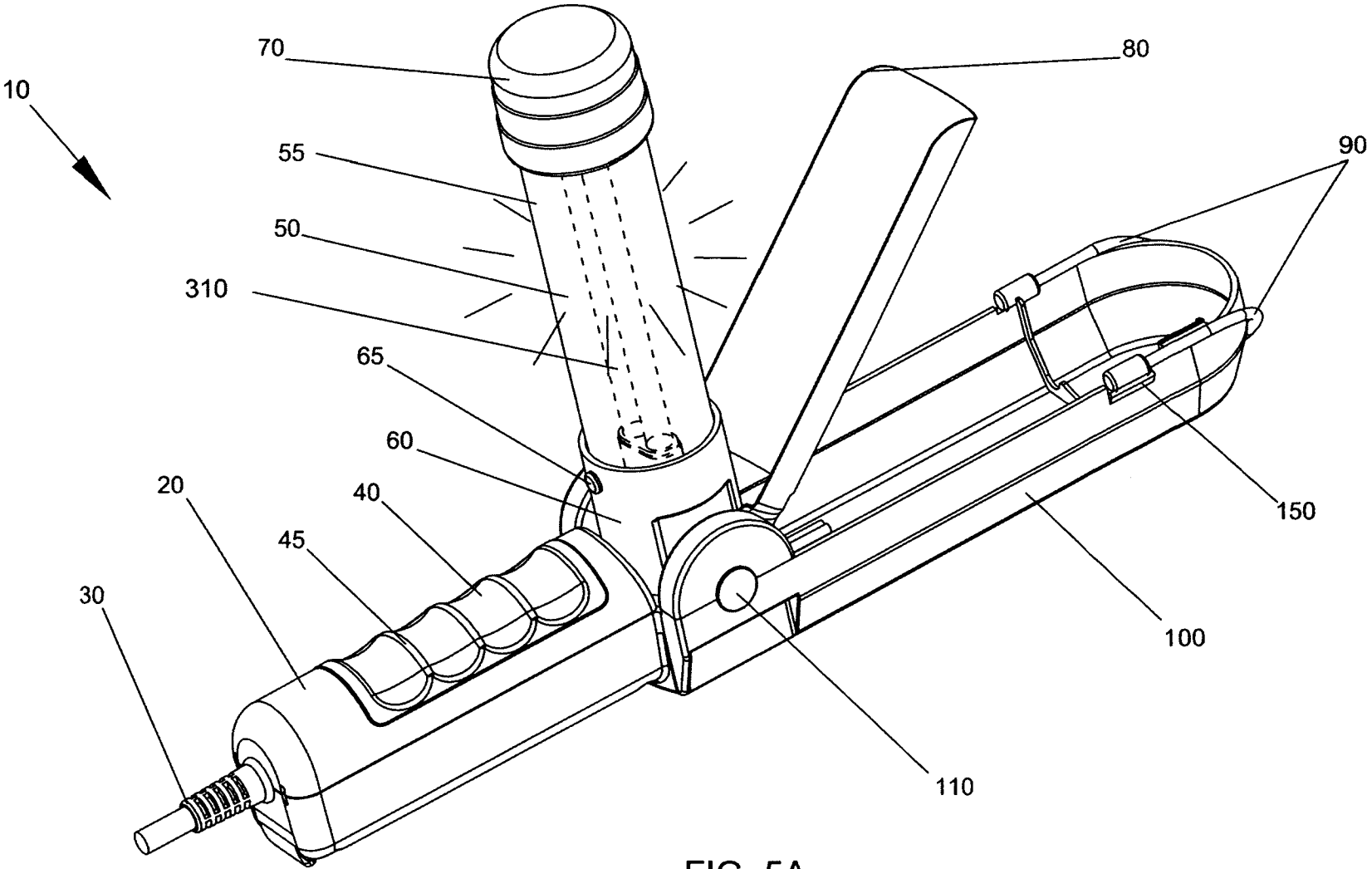
FIG. 5A is a perspective view of an adjustable utility light according to a preferred embodiment of the present invention, showing use of fluorescent tube.
Figure 5B:
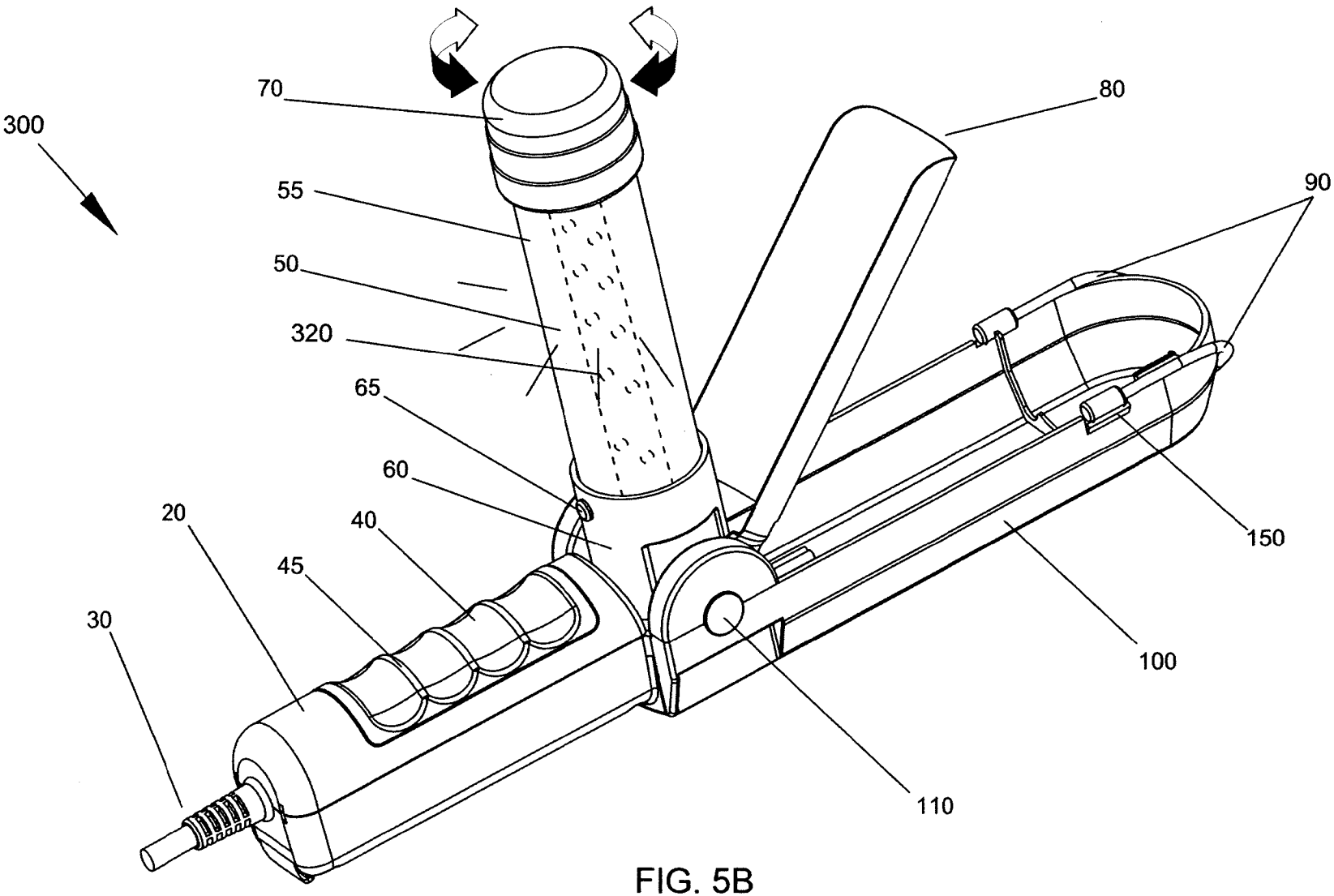
FIG. 5B a perspective view of an adjustable utility light according to an alternate embodiment of the present invention, showing use of light emitting diodes.

Referring now more specifically to FIG. 5B, illustrated therein is yet another alternate embodiment of adjustable utility light 10, wherein the alternate embodiment of FIG. 5B is substantially equivalent in form and function to that of the preferred embodiment detailed and illustrated in FIGS. 1-5A and 6 except as hereinafter specifically referenced. Specifically, the embodiment of FIG. 5B comprises utility light 300, wherein utility light 300 comprises light emitting diode bulb 320. In this alternate embodiment, lens 55 is optional due to robust nature of light emitting diode bulb 320, but may be selectively utilized for protection if necessary and to provide filtering of light for passage of desired wavelengths. In this embodiment, top 70 is in communication with light emitting diode bulb 320, wherein rotation of top 70 rotates light emitting diode bulb 320 by up to 360 degrees.

Figure 7A:
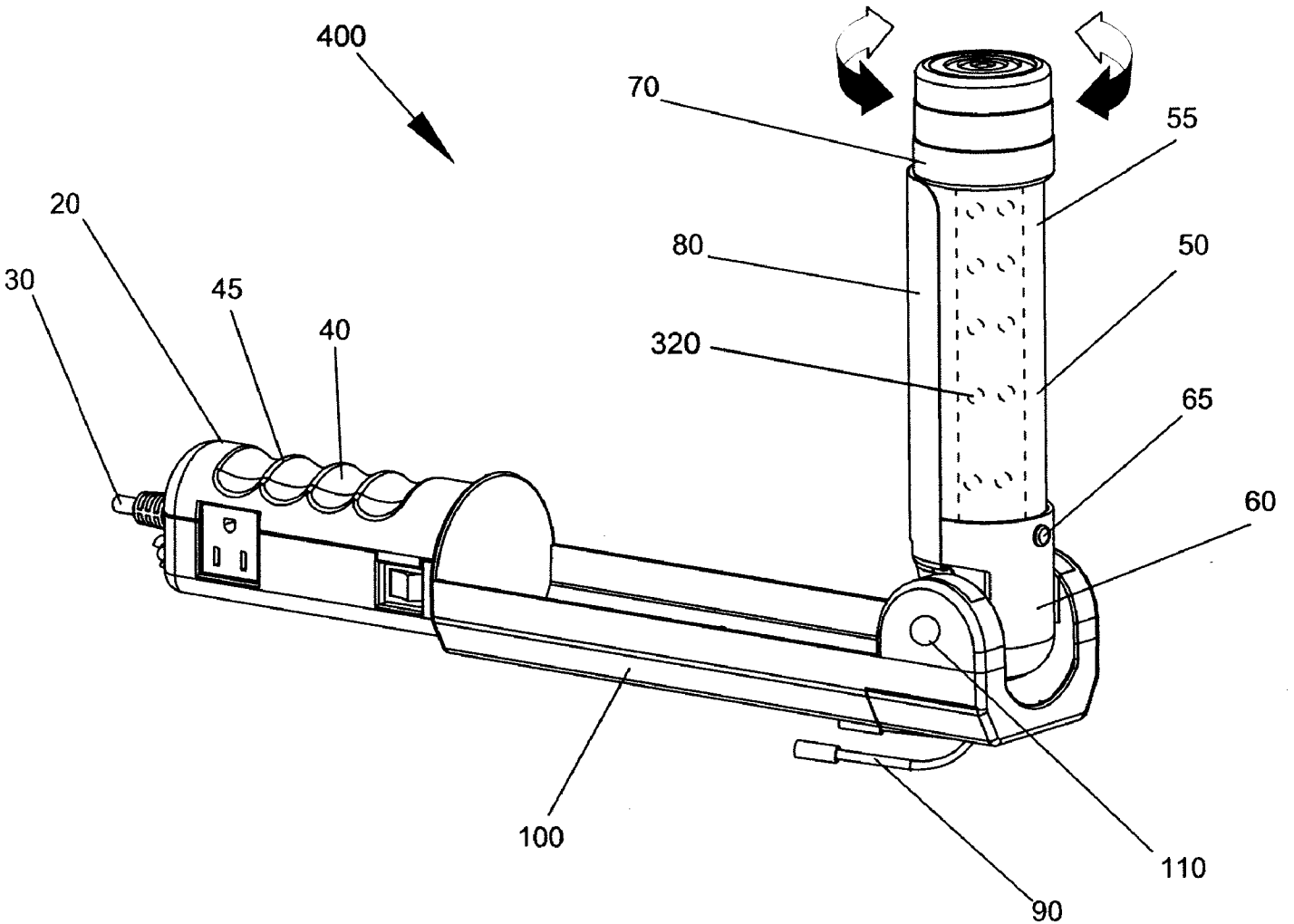
FIG. 7A is a perspective view of an adjustable utility light according to an alternate embodiment of the present invention.
Figure 7B:
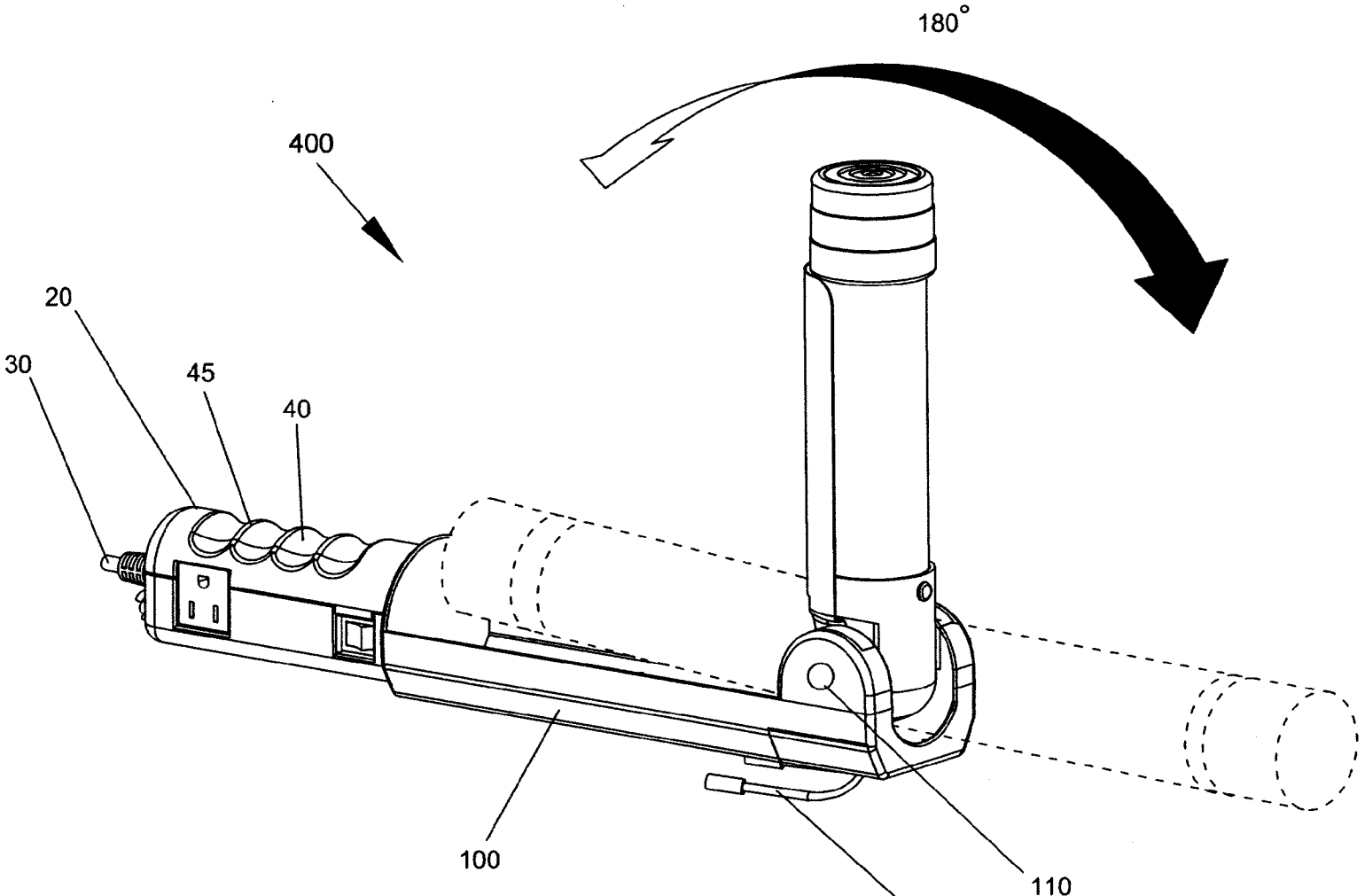
FIG. 7B is a perspective view of an adjustable utility light according to an alternate embodiment of the present invention.

Referring now more specifically to FIGS. 7A and 7B, illustrated therein is still another alternate embodiment of adjustable utility light 10, wherein the alternate embodiment of FIGS. 7A-7B is substantially equivalent in form and function to that of the preferred embodiment detailed and illustrated in FIGS. 1-5A and 6 except as hereinafter specifically referenced. Specifically, the embodiment of FIGS. 7A-7B comprises utility light 400, wherein utility light 400 comprises handle 20, tray 100, reflector 80, hooks 90, pivot 110, lamp 50 and lamp base 60, wherein lamp 50 comprises lens 55 and top 70 and could alternately comprise fluorescent tube 310 or light emitting diode bulb 320. In the embodiment of FIGS. 7A-7B, tray 100 is disposed between pivot 110 and handle 20, wherein disposition of pivot 110 facilitates adjustment of lamp 50 and/or reflector 80 from approximately 0 to approximately 180 degrees. In this embodiment, hooks 90 are disposed proximate pivot 110.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. An adjustable utility light comprising:

a body section;

a pivoting lamp section; and a movable reflector, wherein said pivoting lamp section and said movable reflector pivot about a same pivot axis, and wherein said movable reflector is further pivotable about said pivot axis away from said pivoting lamp section by an angle of up to one-hundred-and-eighty degrees.

2. The adjustable utility light of claim 1, further comprising a hook set.

3. The adjustable utility light of claim 2, wherein said hook set comprises two independently movable hooks.

4. The adjustable utility light of claim 3, wherein said movable hooks independently pivot.

5. The adjustable utility light of claim 3, wherein each of said movable hooks is slidably extendable and pivotable independently.

6. The adjustable utility light of claim 1, wherein said adjustable utility light further comprises fluorescent lamp tubes.

7. The adjustable utility light of claim 1, wherein said adjustable utility light further comprises light emitting diodes.

8. The adjustable utility light of claim 1, further comprising a replaceable lamp.

9. The adjustable utility light of claim 1, further comprising a power outlet.

10. The adjustable utility light of claim 1, further comprising a component retention tray.

11. The adjustable utility light of claim 1, further comprising at least one keyhole mounting slot.

12. A method of lighting a work area, said method comprising the steps of:

obtaining a task light having a pivoting lamp section and a pivotal reflector, wherein said pivoting lamp section and said pivotal reflector pivot about a same pivot axis, and wherein said pivotal reflector is further pivotable about said pivot axis away from said pivoting lamp section by an angle of up to one-hundred-and-eighty degrees; and pivoting said lamp section to provide optimum desired light to a work object.

13. The method of lighting of claim 12, wherein said method further comprises the step of:

disposing said reflector proximate said lamp section.

14. The method of lighting of claim 12, wherein said task light has a set of hooks, further comprising the step of:

hanging said task light on a selected object via at least one of said set of hooks.

15. The method of lighting of claim 14, wherein said step of hanging further comprises the step of:

swiveling said at least one of said set of hooks.

16. The method of lighting of claim 14, wherein said step of hanging further comprises the step of:

slidably extending said at least one of said set of hooks.

17. A task light comprising:

a body section having a component tray:

a pivoting lamp section; and a pivoting reflector, wherein said lamp section and said reflector pivot up to 180 degrees about a common pivot axis, and wherein said pivoting reflector is further pivotable about said common pivot axis away from said pivoting lamp section by an angle of up to one-hundred-and-eighty degrees.

18. The task light of claim 17, further comprising at least one hook.

19. The task light of claim 18, further comprising a light source selected from the group consisting of fluorescent tubes, light emitting diodes, and combinations thereof.

* * * * *